US009487385B2

(12) United States Patent
Mills

(10) Patent No.: US 9,487,385 B2
(45) Date of Patent: Nov. 8, 2016

(54) ADJUSTABLE HALTER

(71) Applicant: Brett W. Mills, Redmond, OR (US)

(72) Inventor: Brett W. Mills, Redmond, OR (US)

( * ) Notice: Subject to any disclaimer, the term of this patent is extended or adjusted under 35 U.S.C. 154(b) by 124 days.

(21) Appl. No.: 13/913,894

(22) Filed: Jun. 10, 2013

(65) Prior Publication Data

US 2014/0360142 A1 Dec. 11, 2014

(51) Int. Cl.
*B68B 1/02* (2006.01)

(52) U.S. Cl.
CPC ..... *B68B 1/02* (2013.01)

(58) Field of Classification Search
CPC ..... B68B 1/02; B68B 5/00
USPC ..... 54/24, 85, 1; 119/769, 792, 795, 856, 119/863, 865
See application file for complete search history.

(56) References Cited

U.S. PATENT DOCUMENTS 3,605,384 A * 9/1971 Pacini ..... B68B 1/02 119/865
4,135,348 A * 1/1979 Matthews ..... 54/24
4,337,610 A * 7/1982 Taylor ..... B68B 1/02 54/15
4,376,366 A 3/1983 Miller
4,852,336 A * 8/1989 Gammill ..... 54/24
4,939,818 A * 7/1990 Hahn ..... 24/16 R
5,615,539 A 4/1997 Graham
6,449,815 B1 9/2002 Spiller
D564,139 S 3/2008 Nichols
2005/0034435 A1* 2/2005 Kemp et al. ..... 54/24
2005/0217220 A1* 10/2005 Blocker ..... B68B 1/02 54/24
2010/0229509 A1* 9/2010 Mills ..... 54/82
2012/0024239 A1* 2/2012 Forbes ..... 119/850
2012/0311976 A1* 12/2012 Voigt ..... B68B 1/02 54/24

OTHER PUBLICATIONS

Equi-Web Adjustable Hook & Loop Closure Halter, http://www.horseloverz.com/648026-Equi-Web-Adjustable-Hook-Loop-Closure-Halter.html, pp. 1-2, Admitted Prior Art.

* cited by examiner

*Primary Examiner* — Lisa Tsang
(74) *Attorney, Agent, or Firm* — Leber IP Law

(57) ABSTRACT

Animal head control devices, e.g., halters for horses, are disclosed. In one aspect, the disclosure features an animal head control device comprising: a body dimensioned to receive an animal's head, an adjustable member connected to the body and dimensioned to wrap around at least a portion of the animal's head behind its ears; and a releasable closure configured to secure a first end of the adjustable member to a portion of the body. In some implementations, the halters disclosed herein include a releasable closure that can be easily replaced when damaged or worn, thus extending the useful life of the halter.

11 Claims, 3 Drawing Sheets

ADJUSTABLE HALTER

BACKGROUND

The invention relates to an animal control apparatus, commonly referred to as a halter, intended to be applied to the animal's head. Generally, halters are designed to wrap around the head of an animal, e.g. a horse, for the purpose of catching, holding, leading, tying, or generally controlling the animal. Utilizing a fastener, e.g. a buckle, halters are designed to be removeably attached to the animal.

Halters are subjected to wear through repeated use. Damage to the halter can occur if the animal has a behavioral outburst, e.g. pulls back while tied. When this occurs it is frequently the fastener or closure mechanism that fails due to wear or damage. This may render the halter unusable, e.g., because the clasps typically used on halters are not designed to be easily replaced.

In the event that the halter does not fail under an extreme load, such as when an animal pulls back when tied, the animal could suffer an injury to the head, spinal column, etc.

SUMMARY

Generally, this invention relates to an animal control apparatus (hereafter "halter") to be applied to the animal's head for the purpose of catching, leading, tying, holding or generally controlling the animal. In some implementations, the halters disclosed herein include a releasable closure that can be easily replaced when damaged or worn, thus extending the useful life of the halter.

The present invention allows the user to replace the closure of a halter easily and inexpensively. In addition, the present invention provides for a great amount of adjustability in sizing, allowing a single halter to be utilized on a variety of differently sized animals. In some implementations the halter is designed to safely release under a predetermined force, e.g., when the animal pulls back with sufficient force to be potentially injured by the restraint provided by the halter.

In one aspect, the invention features an animal head control device comprising: a body dimensioned to receive the animal's head, an adjustable member connected to the body and dimensioned to wrap around at least a portion of the animal's head behind its ears; and a releasable closure configured to secure a first end of the adjustable member to a portion of the body.

Some implementations include one or more of the following features. The releasable closure may comprise a fabric strap configured to be threaded through a first receiving element on the body and second receiving element on the adjustable member. The fabric strap may comprise a first region having hook fasteners and a second region having loop fasteners. The fabric strap may be configured so that when the hook fasteners and loop fasteners are engaged at least a portion of one of the regions is captured between two portions of the other region.

In some implementations, the releasable closure can be retained on one of the receiving elements and unthreaded from the other receiving element by disengaging an upper one of the two portions of the other region from the captured portion while the captured portion remains engaged with a lower one of the two portions. The receiving elements may comprise rings, e.g., at least one of the receiving elements may be generally rectangular.

In some cases, the body comprises a plurality of elongated body elements connected by connecting elements, such as rings.

The adjustable member may comprise a flexible strap and a slide buckle configured to allow the available length of the flexible strap to be adjusted, and a first end of the flexible strap may be threaded through the second receiving element and through the slide buckle. In some cases, the adjustable member further comprises a second slide buckle, and a second end of the flexible strap is threaded through a receiving element on the body and the second slide buckle, such that the adjustable member can be removed from the body by unthreading the two free ends of the flexible strap from the respective slide buckles. Alternatively, instead of slide buckles, the adjustable member may comprise a pair or pairs of rectangular rings through which the first end and/or the second end of the flexible strap is threaded.

In another aspect, the invention features methods of using the devices disclosed herein. For example, the invention features a method for controlling an animal's head, comprising placing the animal's head in a body of a head-controlling device, and wrapping an adjustable member connected to the body around at least a portion of the animal's head to position the adjustable member behind the animal's ears, wherein the device includes a releasable closure configured to secure a first end of the adjustable member to a portion of the body.

Some implementations include one or more of the following features. The method further comprises removing the releasable closure and replacing it with a new releasable closure. The releasable closure may comprise a fabric strap configured to be threaded through a first receiving element on the body and second receiving element on the adjustable member. The fabric strap may comprise a first region having hook fasteners and a second region having loop fasteners. The fabric strap may be configured so that when the hook fasteners and loop fasteners are engaged at least a portion of one of the regions is captured between two portions of the other region. The method may further comprise retaining the adjustable member on one of the receiving elements while unthreading it from the other receiving element, to position the adjustable member behind the animal's ears, by disengaging an upper one of the two portions of the other region from the captured portion while the captured portion remains engaged with a lower one of the two portions. The adjustable member may comprise a flexible strap and a slide buckle or pair of rectangular rings, and the method may further include using the slide buckle or pair of rings to adjust the available length of the flexible strap to fit the animal's head.

DETAILED DESCRIPTION

Figure 1:
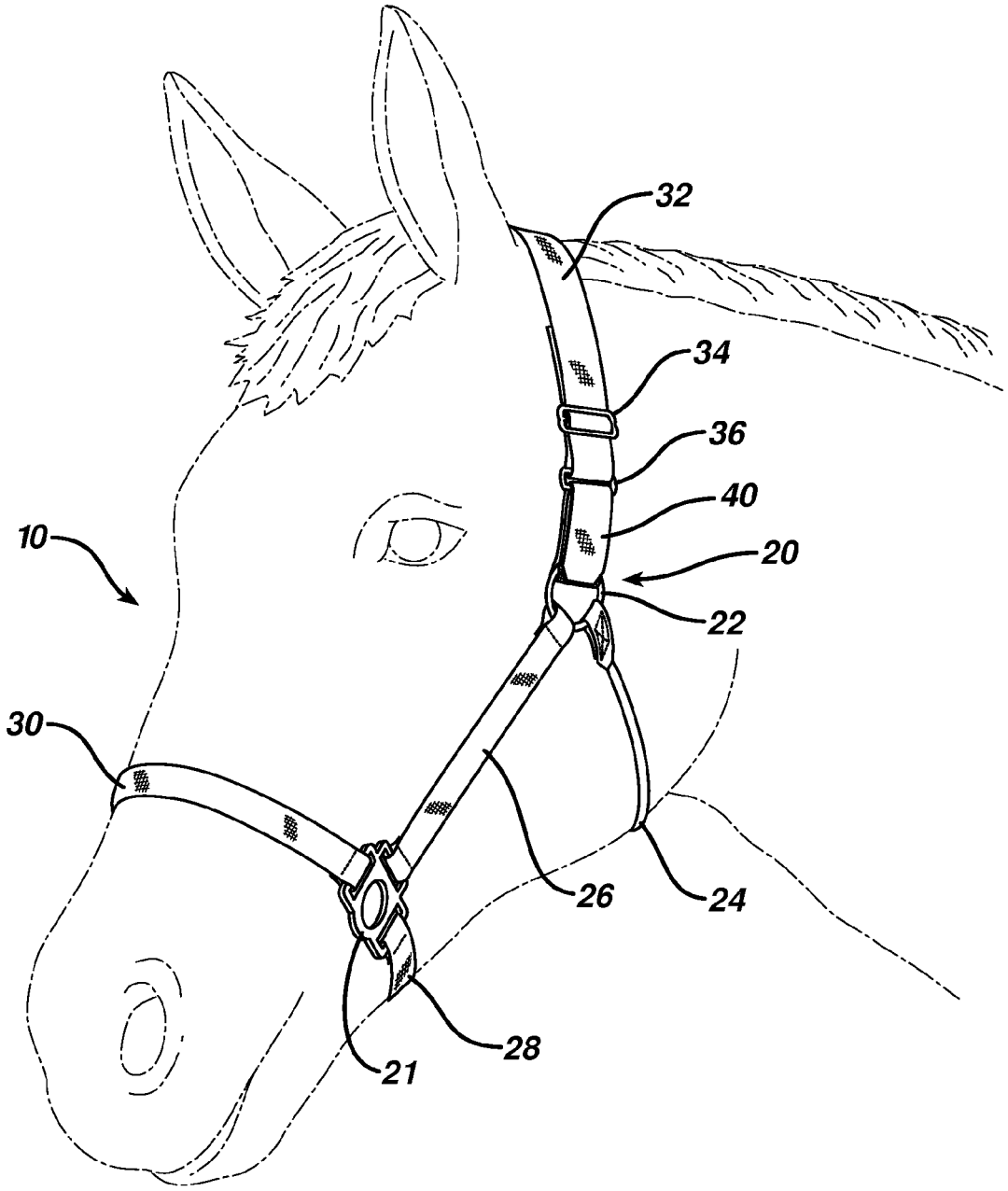
FIG. 1 is a perspective view of a halter according to one implementation on a horse's head.

Referring to FIG. 1, the animal control apparatus, or halter, 20 is applied to an animal's head 10. The halter 20 generally wraps around the animal's head 10, for example, over the nose, under the chin, behind the ears, along the cheeks and under the throat. The halter 20 generally comprises a plurality of elongated members including cheek straps 26 on opposite sides of the halter (only one is shown), a nose piece 30, a chin piece 28, a throat latch 24, a poll band 32, a closure mechanism 40, and metal rings 21, 22, which serve as articulation and connection points for the various members. The members may be formed of any suitable material, for example leather or multi-ply webbing, e.g., nylon webbing. The rings are generally formed of metal, and may be of any desired shape.

Referring to FIG. 1, the poll band 32 is attached on one side of the halter 20 to the ring 22 via releasable closure 40 and closure ring 36, which provides a receiving element through which the poll band and releasable closure are threaded. The poll band 32 runs through a sliding buckle 34 then loops around the closure ring 36 and back through the sliding buckle 34. This configuration provides adjustability to the poll band 32, allowing the user to easily configure the halter 20 to animals with differently dimensioned heads. The opposite end of the poll band (not shown) is attached to the halter 20 via a ring similar to ring 22, and may be secured either by stitching, fabric weld, or through threading through a slide buckle. One free end of the releasable closure 40 threads through the closure ring 36 from the other side, while the other free end threads through ring 22, such that the releasable closure provides a releasable link between the cheek strap 26 and poll band 32.

Figure 2:
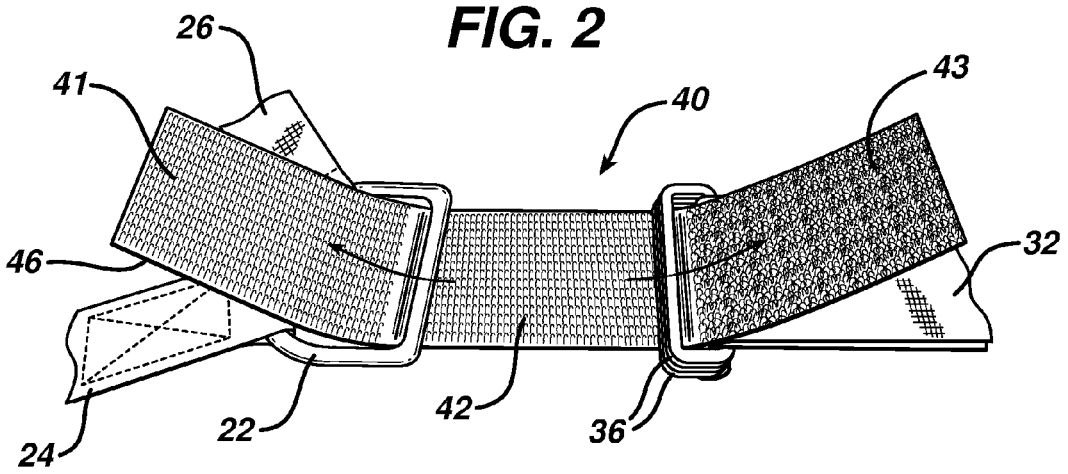
FIG. 2 is a perspective view of the releasable closure of the halter shown in FIG. 1, in the open position.
Figure 3:
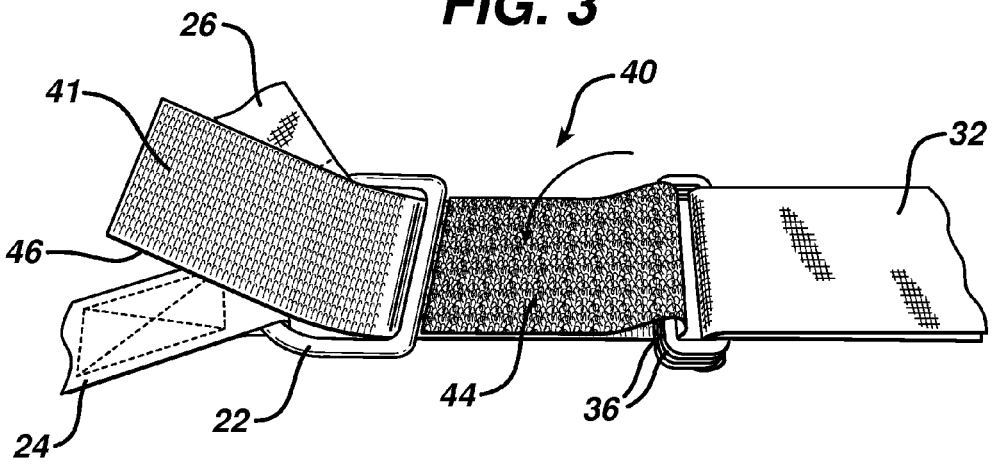
FIG. 3 is a perspective view of the releasable closure with one portion in the closed position.
Figure 4:
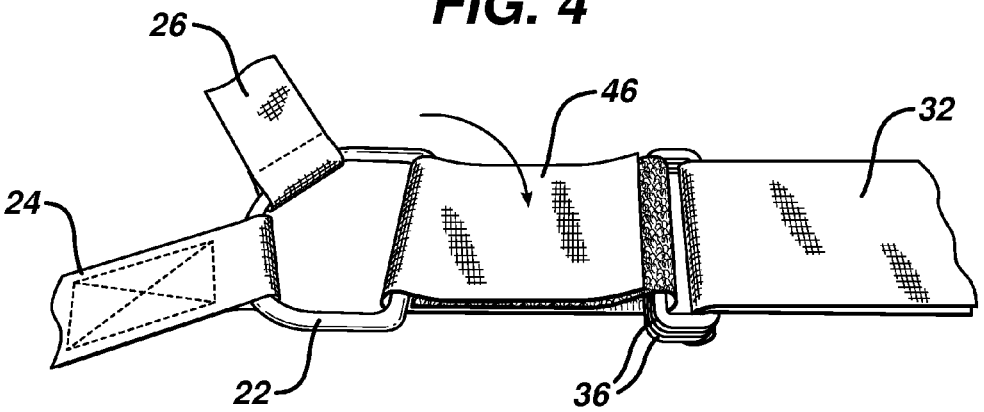
FIG. 4 is a perspective view of the releasable closure with two portions in the closed position.

Thus, as shown in FIG. 1, the releasable closure 40 secures the halter 20 to the animal's head 10. Referring to FIGS. 2-4, the releasable closure 40 utilizes a combination of hook and loop fabric fasteners oriented on opposing surfaces to achieve a strong, releasable bond. To remove the halter from the animal, the user need only disengage element 46, as shown in FIG. 3, and unthread it through ring 22, which releases the poll band 32. The releasable closure 40 will be discussed in detail below.

In the preferred implementation shown in FIGS. 2-5, releasable closure 40 includes a substantially planar elongated band of material having first and second portions. The first portion includes loop fasteners on both of its opposite surfaces 43 and 44. This may be achieved, for example, by attaching two pieces of loop material back-to-back, or by providing a two-sided loop material. The second portion, which extends lengthwise from the first portion, includes two side-by-side surfaces 41 and 42, both of which carry hook elements. In preferred implementations the opposite surface 46 of the second portion is free of fastener elements, and may be smooth or may have any desired texture. This configuration allows the releasable closure to be folded in thirds such that when the releasable closure is closed the first portion is captured between the two surfaces 41 and 42 of the second portion, and the generally smooth surface 46 is exposed.

Referring to FIGS. 2 and 3, to initially position the releasable closure 40 on the halter, e.g., when replacing the releasable closure, the releasable closure 40 is looped through the rings 36 and the surface 43 is folded back on to surface 42 (FIG. 3). Preferably, surface 43 includes loop fasteners and surface 42 includes complementary hook fasteners as shown. The interaction of these two surfaces forms a strong releasable bond, which would generally only be disengaged when the releasable closure 40 needs to be replaced due to material deterioration or damage.

Referring to FIGS. 3 and 4, to fasten the halter on an animal the second portion of the releasable closure is threaded through the ring 22 and hook-carrying surface 41 is folded over onto the corresponding loop fasteners on surface 44, capturing the first portion of the releasable closure as discussed above.

Figure 5:
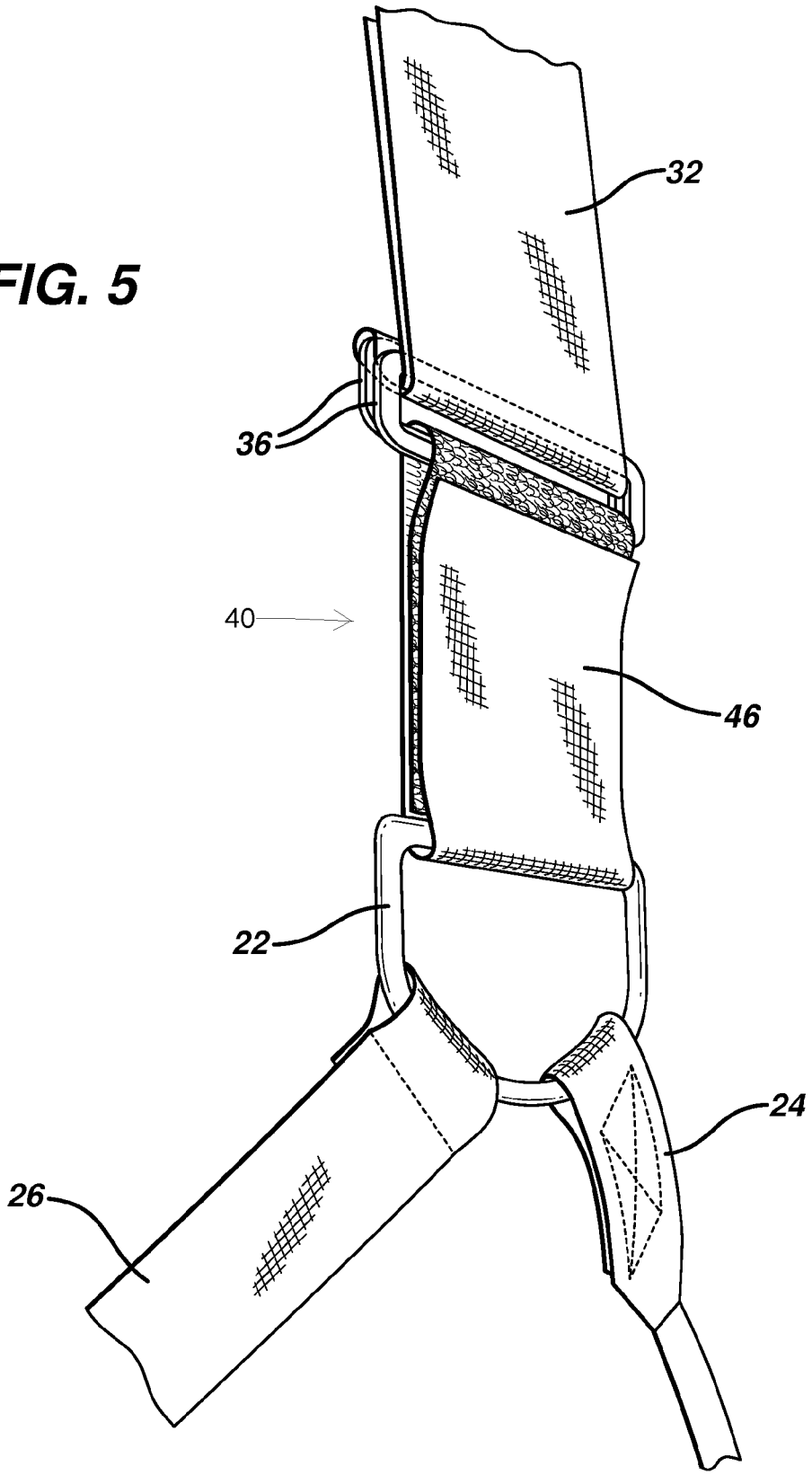
FIG. 5 is a perspective view of the preferred embodiment of the releasable closure in the closed position.

Referring to FIG. 5, the releasable closure 40 is shown in the preferred orientation. Disengagement of the releasable closure would be accomplished by pulling down on surface 46. This would allow the releasable closure 40 to unthread through ring 22 allowing removal of the halter 20 from the animal's head. Poll band 32 is shown looping through two rectangular rings 36, around the second ring and then back through the first ring. This configuration prevents slippage or unwanted change of length of the poll band 32. This configuration provides easy adjustment of the length of the poll band to allow the halter be utilized on differently dimensioned animal heads.

The releasable closure 40, in the event of an emergency, would allow for quick release of the animal's head from the halter 20 helping prevent injury to the animal. The releasable closure 40 and/or the closure ring 36 can be designed to release or fail under a predetermined load that is representative of the force produced in such a situation, or the releasable closure 40 can be released manually by the animal's handler.

The strength of the bond between the first and second portions, and thus the force required to disengage the releasable fastener, can be increased or decreased by altering the amount of interaction between the complementary surfaces 41 and 44. This can be done by the animal's handler, by only partially overlapping the complementary surfaces, or by the manufacturer, e.g., by providing fewer complementary fasteners, less aggressive hook fasteners, or bands of hook fasteners rather than a continuous array of hook fasteners.

In some implementations, the releasable closure 40 utilizes woven nylon hook and loop material measuring from ¾ to 3 inches in width, but preferably e.g. 2 inches in width. The poll band 32, in some embodiments, is configured to match the width of the releasable closure 40. The poll band 32, in some embodiments, utilizes a flat, woven nylon material but can be leather or any other material that meets the necessary strength and aesthetic requirements.

OTHER EMBODIMENTS

A number of embodiments have been described. Nevertheless, it will be understood that various modifications may be made without departing from the spirit and scope of the disclosure.

For example, many different configurations of where the hook and loop fasteners are located on the closure device are possible so that similar results are achieved.

An alternate embodiment may feature a poll band that is removable/replaceable from the body of the halter by having the poll band be removable from the body of the halter on both sides of the horse's head. Removability can be accomplished, for example, by having a second sliding buckle or pair of rectangular rings at the other end of the poll band, or a sliding buckle or pair of rings and a second releasable closure similar to the releasable closure 40.

Another embodiment may feature different types of rings to accommodate different types or sizes of materials. For example, the rings may be round, rectangular or box-shaped, D-shaped, or have any other desired configuration.

Accordingly, other embodiments are within the scope of the following claims.

What is claimed is:

1. An animal head control device comprising:

a body dimensioned to receive an animal's head, the body comprising a plurality of elongated members, which include a pair of cheek straps configured to extend along cheeks of the animal;

an adjustable poll band dimensioned to wrap around at least a portion of the animal's head behind its ears; and a releasable closure releasably connecting a first receiving element connected to a first proximal end of the adjustable poll band to a second receiving element connected to a proximal end of one of the cheek straps, the releasable closure being located between and spaced from the first proximal end of the adjustable poll and the proximal end of the one of the cheek straps, the releasable closure comprising a fabric strap that includes a first region having hook fasteners and a second region having loop fasteners, configured so that when the hook fasteners and loop fasteners are engaged, at least a portion of one of the regions is captured between two portions of the other region, allowing the releasable closure to be retained on one of the receiving elements when the releasable closure is opened to remove the device from the animal's head;

wherein the body and releasable closure are configured so that the device can only release at the releasable closure an ensnarement event, and will break away at the releasable closure upon ensnarement.

2. The animal head control device of claim 1, wherein the fabric strap is configured to be threaded through the first receiving element and the second receiving element.

3. The animal head control device of claim 1, wherein the releasable closure is configured to be retained on one of the receiving elements and unthreaded from the other receiving element by disengaging an upper one of the two portions of the other region from the portion of the one of the regions that is captured while the portion of the one of the regions that is captured remains engaged with a lower one of the two portions.

4. The animal head control device of claim 2, wherein the receiving elements comprise rings.

5. The animal head control device of claim 3, wherein at least one of the receiving elements is generally rectangular.

6. The animal head control device of claim 1 wherein the plurality of elongated members are connected by connecting elements.

7. The animal head control device of claim 6 wherein the connecting elements comprise rings.

8. The animal head control device of claim 2 wherein the adjustable poll strap comprises a flexible strap and a slide buckle or pair of rectangular rings configured to allow a length of the flexible strap to be adjusted, and a first end of the flexible strap is threaded through the second receiving element and through the slide buckle or pair of rings.

9. The animal head control device of claim 8 wherein the adjustable poll strap further comprises a second slide buckle or second pair of rectangular rings, and a second end of the flexible strap is threaded through a receiving element on the body and the second slide buckle or pair of rings, such that the adjustable poll strap can be removed from the body by a user, by the user unthreading the flexible strap from the respective slide buckles or pairs of rings.

10. The animal head control device of claim 1 wherein the elongated members comprise webbing straps.

11. An animal head control device comprising:

a body dimensioned to receive an animal's head, the body comprising a plurality of elongated members, which include a pair of cheek straps configured to extend along cheeks of the animal;

an adjustable poll band dimensioned to wrap around at least a portion of the animal's head behind its ears; and a releasable closure releasably connecting a first receiving element connected to a first proximal end of the adjustable poll band to a second receiving element connected to a proximal end of one of the cheek straps, the releasable closure being located between and spaced from the first proximal end of the adjustable poll and the proximal end of the one of the cheek straps, the releasable closure comprising a fabric strap that includes a first region having hook fasteners and a second region having loop fasteners, configured so that when the hook fasteners and loop fasteners are engaged, at least a portion of one of the regions is captured between two portions of the other region, allowing the releasable closure to be retained on one of the receiving elements when the releasable closure is opened to remove the device from the animal's head;

wherein the body and releasable closure are configured so that the device can only release at the releasable closure in an ensnarement event, and will break away at the releasable closure upon ensnarement; and wherein the releasable closure is held in place on the receiving elements by engagement of the hook fasteners with the loop fasteners, and thus the releasable closure is removable from the receiving elements by a user by simply releasing the hook and loop fasteners.

* * * * *